United States Patent [19]

Frystak

[11] 4,049,257

[45] Sept. 20, 1977

[54] DOCUMENT FEEDER APPARATUS

[75] Inventor: Richard Frystak, Park Ridge, Ill.

[73] Assignee: Bell & Howell Company, Chicago, Ill.

[21] Appl. No.: 683,112

[22] Filed: May 4, 1976

[51] Int. Cl.[2] ..... B65H 1/12; B65H 1/18; B65H 3/52

[52] U.S. Cl. ..... 271/114; 271/122; 271/125; 271/126; 271/153; 271/154; 271/160

[58] Field of Search ..... 271/126, 160, 152, 153, 271/154, 155, 156, 114, 122

[56] References Cited

U.S. PATENT DOCUMENTS

| | | | |
|---|---|---|---|
| 1,285,432 | 11/1918 | Shults | 271/156 |
| 2,992,820 | 7/1961 | Tarbuck et al. | 271/126 X |
| 2,997,297 | 8/1961 | Fox | 271/122 |

*Primary Examiner*—Bruce H. Stoner, Jr.

*Attorney, Agent, or Firm*—Robert A. Walsh

[57] ABSTRACT

A sheet feeder apparatus having a feed roller, a reverse roller, a movable sheet support platform for furnishing sheets from a stack to the feed roller, and a pivotable arm with pickup roller for engaging the stack of sheets on the support platform. The sheet support platform is spring driven and equipped with a brake mechanism operable responsive to movement of the pivotable arm which is caused by feeding of sheets from the stack, thereby to permit the spring to drive the sheet support mechanism into further feeding disposition. The nip between the feed roller and reverse roller of the apparatus may be selectively controlled to accommodate sheets of various thicknesses by means of a pivot shaft connected to the reverse roller, which shaft has a levered end engaging a manually operated adjustment cam and release lever mechanism.

10 Claims, 4 Drawing Figures

DOCUMENT FEEDER APPARATUS

BACKGROUND OF THE INVENTION

The present invention generally concerns a sheet feeder apparatus and more particularly a document handling mechanism for feeding documents individually and selectively from a stack thereof into associated document processing apparatus, such as a photographic instrument for recording the visual indicia appearing thereon.

Several different types of document feeder devices are known in the prior art. One such device is described in U.S. Pat. No. 2,992,820 to Tarbuck et al. A number of difficulties have been associated with the particular document feeders known heretofore. Among such difficulties has been the inability to provide an apparatus which will accommodate documents of varying thickness, if at all, without troublesome adjustments and delays resulting in expensive down time. Another material disadvantage of such prior art sheet feeder systems has been the necessity of removing and replacing various components of the apparatus during initial loading thereof with the sheets to be fed.

In many such prior art document feeders, unless frequent adjustments were made, the feeding pressure varied sufficiently greatly from document to document during individual document feeding to promote jamming. Still other prior art feeders have required several manual steps in their operation which resulted in slow and inefficient operation. Yet another of the feeder devices known heretofore have lacked means for automatically adjusting the feeder for documents of various thicknesses, which has greatly reduced the versatility of the device and increased the operational cost to the consumer.

Each of the aforementioned defects and/or difficulties ha reduced the commercial acceptance, usability and saleability of prior art feeder devices. Accordingly, it is an object of the present invention to alleviate materially the above noted deficiencies of the prior art and to provide an improved document feeder apparatus.

It is another object of the present invention to provide a spring driven document feeder which is equipped with a brake mechanism operable in response to a pivotable arm engaging the documents and moveable from a first position to a second position to close and open a switch controlling the brake mechanism.

It is also an object of the present invention to provide a document feeder apparatus in which the nip between drive and reverse rollers may be controlled or completely disengaged for the processing of documents of various thicknesses by providing lever-ended shaft means for pivoting one such roller.

These and other objects and features accomplished by the present invention will be better understood with reference to the following summary of the invention, drawings and detailed description thereof.

SUMMARY OF THE INVENTION

A sheet feeder apparatus in accordance with the present invention has a sheet support platform for supporting a stack of sheets to be fed individually into associated equipment for processing, such as for example photographic equipment for recording the visual indicia appearing thereon. Such sheet feeder apparatus has found particular utility in the feeding and recording of cancelled checks.

After manual loading of sheets thereon, the sheet support platform is moved within the feeder frame toward a pivotable arm mechanism at the urging of a coil spring until the stack of sheets engages therewith. When such engagement occurs, the arm mechanism pivots from a first position to a second position to open a switch controlling a brake means for overcoming the drive means. As sheets are fed from the stack, the pivotable arm pivots back to the first position closing the switch and thereby releasing the brake.

A clutch may be disposed between the motor means and the pinion gear, such that the rack may be depressed for document loading, which would rotate the associated pinion gear, but would not impart any reverse rotational movement to the motor brake means shaft to prevent thereby damage to the high torque motor.

A pivotable arm mechanism which engages the stack of sheets for feeding preferably comprises a pickup roller pulleyed to a feed roller. When the stack is exhaused, the pickup roller may engage an idler roller disposed on the sheet support platform to prevent thereby damage to the pickup roller.

In one embodiment the brake means may be an electric motor connected to a rack and pinion. The rack thereof is connected to the sheet support. When the switch is opened by the engagement of the sheets with the pivotable arm, electric current to the motor is cut off and the motor output shaft stationarily holds the pinion in non-rotative position to secure the rack-connected sheet support against the urging of the spring drive.

A reverse roller is disposed below and may engage the feed roller, but is pivotably mounted for adjustment or disengagement thereof to accommodate documents of various thicknesses or very thick documents respectively. Such control of the nip between the rollers is provided by a pivotable, reverse roller bracket connected to one end of a nip control shaft. The shaft is operated in response to a nip control mechanism abutting on an opposite, levered end of the nip control shaft, such that the pivotable, reverse roller bracket may be pivoted downwardly in response to partial rotation of the nip control mechanism. Such downward pivoting lowers the reverse roller from the feed roller to adjust thereby the nip therebetween.

DETAILED DESCRIPTION OF THE DRAWING

Figure 1:
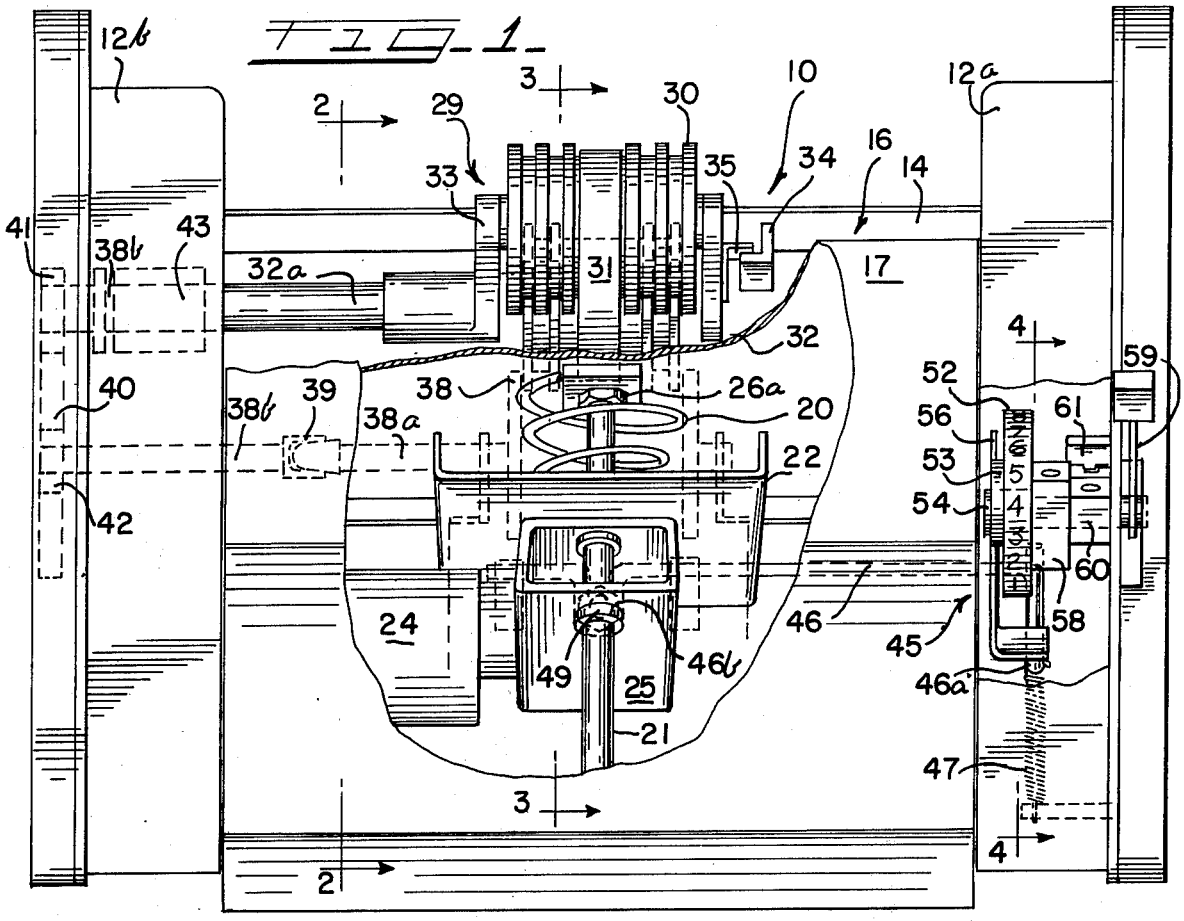
FIG. 1 is a front elevational view of a document feeder in accordance with the present invention with the front plate partially cut away to show particularly the sheet support means and the means for driving and braking it (including a spring means, a rack and pinion, and a motor means), a cam operated document thickness adjuster and/or roller disengaging mechanism, pickup, feed and reverse rollers, and means for driving the rollers.

Referring now to FIG. 1, a sheet handling mechanism shown generally at 10 has side frame portions 12*a*, 12*b* and back frame portion 14 adapted for sliding such sheet handling mechanism 10 into associated sheet processing equipment, such as a photographic recorder apparatus (not shown), and for supporting the other element of the apparatus. An enclosed sheet support platform mechanism, shown generally as 16 with part of its front plate 17 cut away to show the internal structure thereof, serves to support the documents during feeding.

Figure 3:
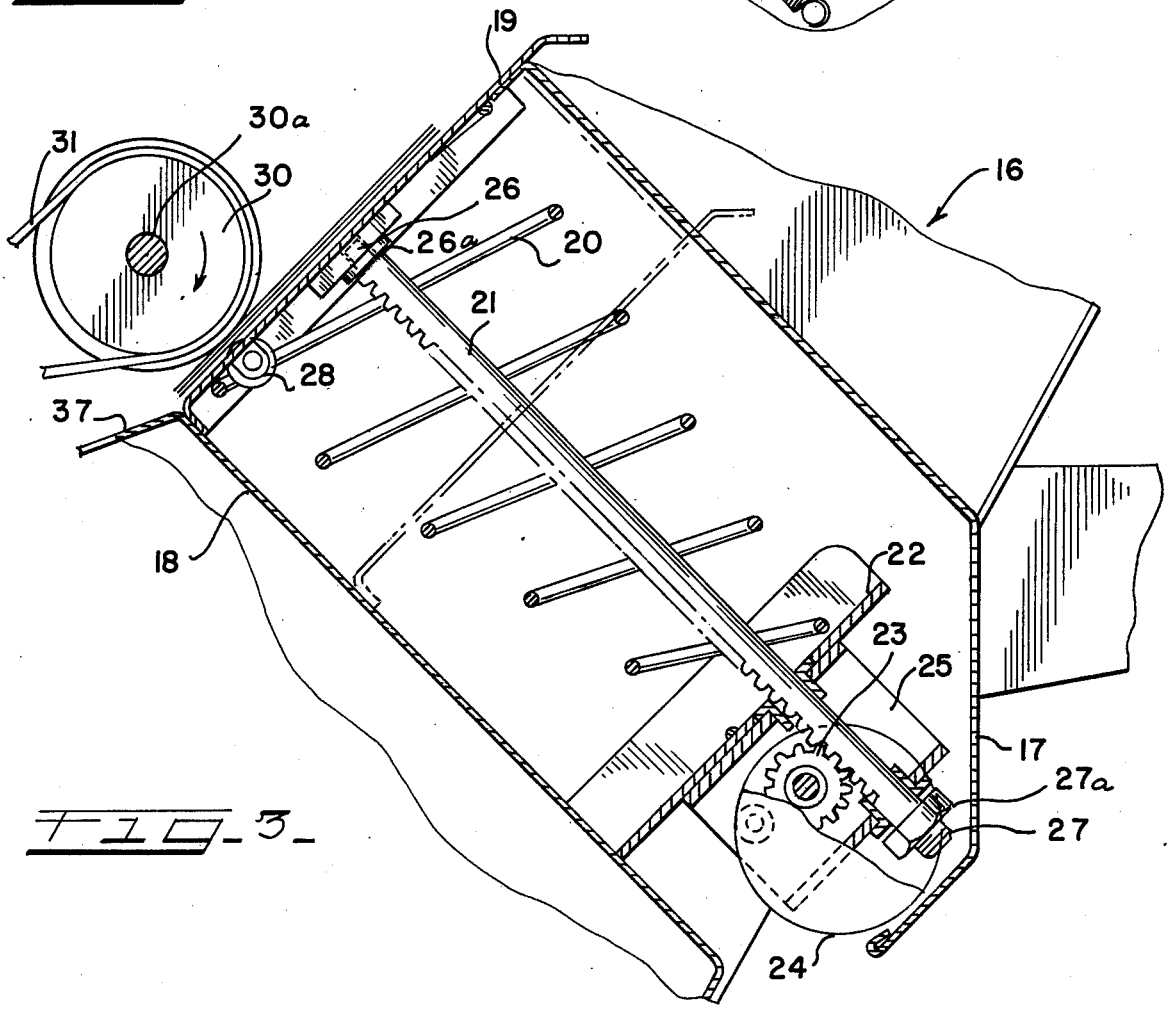
FIG. 3 taken along line 3—3 of FIG. 1 is an enlarged side view of the sheet platform mechanism, including a rack and pinion, a spring means, a motor brake means, and a platform idler roller engaging the pickup roller.

Referring also now to FIG. 3, sheet support mechanism 16 is enclosed by front plate 17, back plate 18, and a top disposed sheet support plate 19. Support mechanism 16 is urged upwardly by a spring drive means which is shown in the form of a coil spring 20 which is axially disposed on rack 21 and confined between the support plate 19 and coil spring plate 22.

A means for braking the urging of coil spring 20 is provided and preferably comprises motor 24, and associated rack 21 and pinion gear 23. Rack 21 having threaded end portions 26, 27 is secured by top and bottom bolts 26*a*, 27*a* to support mechanism 16. Rack 21 meshes with pinion gear 23 for securing sheet support mechanism 16 when motor 24 is not operative. Motor means 24 is preferably in the form of a high torque electric motor and is connected to pinion 23 through a gear box 25, which preferably contains a mechanical slip clutch to permit platform 16 to be manually lowered for loading with a stack of documents without reverse turning of the output shaft of motor 24, which could damage it. Motor 24 acts as a brake to overcome the upward urging of coil spring 20 and to thereby prevent upward movement when no electric current is flowing thereto. However, when current is flowing to motor 24, the urging of coil spring 20 moves sheet support mechanism 16 upwardly.

Figure 2:
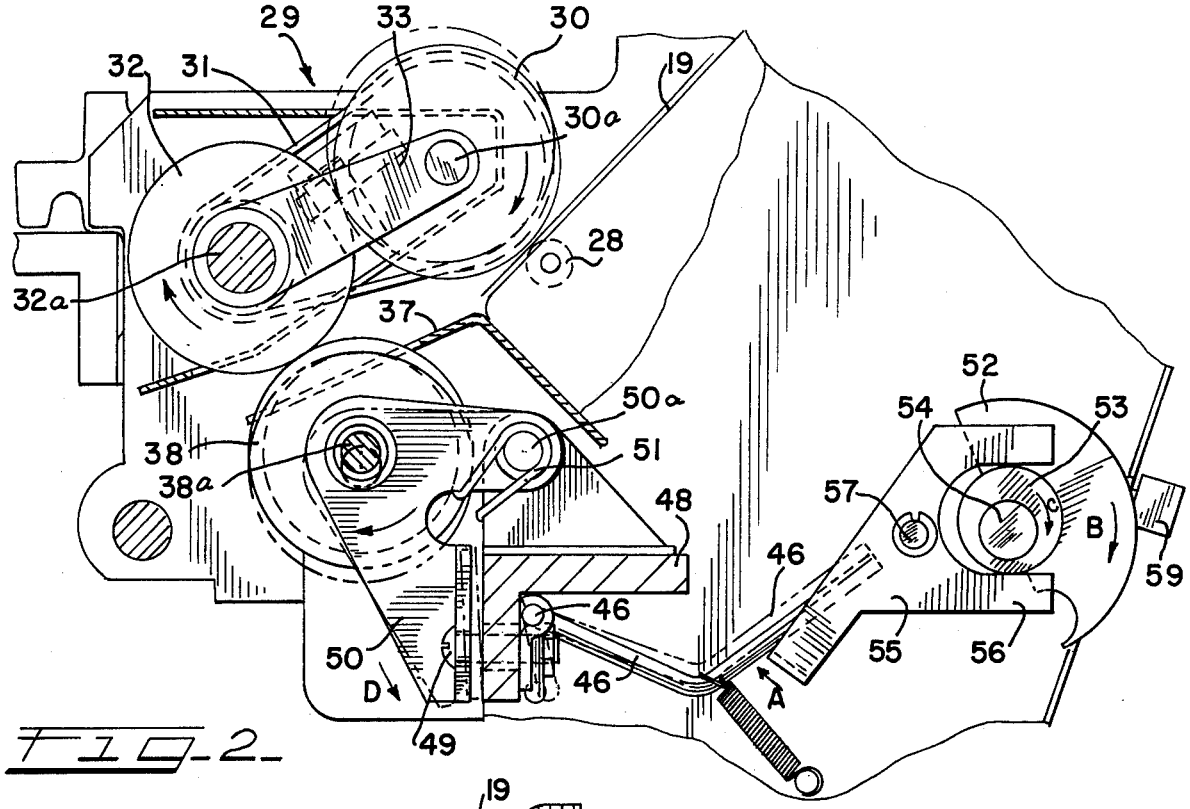
FIG. 2 taken along line 2—2 of FIG. 1 is an enlarged side view with the sheet support mechanism cut away to show the feed roller mechanism and the mechanism for adjusting the nip between the feed and reverse rollers to accommodate documents of various thicknesses.

As shown in FIGS. 2 and 3, sheet support plate 19 preferably has a spring loaded idler roller 28 projecting above its surface to engage with pickup roller 30 when the stack of documents being loaded has become exhausted, to prevent damage to such pickup roller. Idler roller 28 may be spring loaded by coil spring 20 or by a separate spring in alternative embodiments.

Referring now to FIGS. 1, 2 and 3, the pivotable arm mechanism shown generally at 29 has a pickup roller 30 connected by belt 31 to a roller 32. Such rollers 30, 32 are mounted respectively on pivot braket 33 by pickup shaft 30*a* and feed roller drive shaft 32*a*.

Pivotable arm mechanism 29 is spring loaded to urge pickup roller 30 from a first position downwardly into a second or pickup position to close a switch 34 by means of a switch closing trigger 35. FIG. 2 shows pickup roller 30 in such second or closed position. Switch 34, when operative, permits coil spring 20 to urge sheet platform 19 upwardly and into contact with pickup roller 30.

Bracket 33 then pivots about feed roller shaft 32*a*, as shown in dotted lines in FIG. 2, in response to such upward urging of sheet support mechanism 16 and any sheets loaded thereon. The upward movement of pickup roller 30 into such first position, in response to the urging of the stack of sheets on support plate 19, then opens switch 34, whereby current to motor brake 24 is shut off. The shaft on motor 24 then ceases to rotate, holds the rack and pinion stationary, and thereby acts as a brake to overcome the upward urging of coil spring 20 and to prevent thereby further upward motion of sheet support mechanism 16.

When pickup roller 30 has been pivoted upwardly into its pickup position engaging a stack of sheets, the pressure exerted between plate 19 and pickup roller 30 is sufficient to skim sheets individually from the loaded stack of sheets. The skimmed sheet is directed along feed plate 37 into the nip formed by feed roller 32 and reverse bias roller 38 which rejects any more than one sheet. Pickup roller 30 and the other rollers are preferably constructed of a material such as rubber to provide a suitable frictional surface for feeding. Rollers 30, 32 and 38 preferably have slotted surfaces to engage each other, as shown in FIG. 1.

As shown in FIGS. 1 and 2 reverse roller 38 is driven by reverse rotation drive shaft 38*a*. The extent of the nip engagement between drive roller 32 and reverse drive roller 38 may be adjusted for documents of various thickness or may be completely disengaged to feed very thick documents by pivoting reverse roller 38 downwardly away from feed roller 32, as shown in dotted lines in FIG. 2. In order to do so, its associated reverse drive shaft 38*a* must also move downwardly. Thus, a universal coupling 39, as shown in FIG. 1, is provided on shaft 38*a* to accommodate such movement. A reverse drive shaft 38*b* is connected at the opposite end of universal coupling 39. Additionally, an electric clutch 43 may be connected at its output end to feed roller drive shaft 32*a* to provide selective rotation thereto in response to electric current supplied. A drive shaft 32*b* is then connected to clutch 43 at its input end to provide rotation from the driving gears.

Drive shafts 32*b* and 38*b* are driven simultaneously but not at the same speed or in the same rotational direction, by an interconnecting, toothed pulley 40 driving the gears 41, 42 disposed on shafts 32*b*, 38*b* respectively. Gear-interconnecting pulley 40 is driven by a shaft drive means (not shown) associated with the sheet processing equipment into which the sheets are fed. Accordingly, shafts 32*b* and 38*b* are constantly driven as long as the sheet drive means on the associated sheet processing equipment is operating. However, sheet feeding may be selectively interrupted by deactivating the electric clutch 43, as shaft 32*a* and pulley 31 to the pickup roller 30 would not then be operational. A push button switch (not shown) to electric clutch 43 is conveniently disposed such that the operator may interrupt feeding, feed the sheets individually, or feed an entire stack of sheets automatically.

Referring to FIG. 1, the roller nip control mechanism generally designated at 45 is supported by side frame 12*a* and functions to operate a nip control shaft 46 (shown in dotted lines in FIG. 1), which is spring loaded by spring 47. Nip control shaft 46 is operatively engaged at a levered end 46*a* thereof by nip control mechanism 45 and at the opposite, bracket end 46*b* to a nip control bracket 48, as shown in FIG. 2. Bracket 48 is connected by bolt 49 to reverse roller bracket 50, which is spring loaded by nip control spring 51 to urge bracket 50 and hence reverse roller 38 upwardly into engagement with feed roller 32. Thus, bracket 50 is disposed to pivot about shaft 50*a*. Dotted lines in FIG. 2 show the nip adjustment motion by which reverse roller 38 is lowered from its engagement with drive roller 32 (See arrow D). When lever end 46a on shaft 46 is urged upwardly, as shown by arrow A of FIG. 2, shaft 46 is rotated in a counter-clockwise direction to pivot bracket 50 about its pivot shaft 50a, to thereby lower reverse roller 38 from its engagement with feed roller 32.

The described nip adjustment motions initiated (as shown by arrow A) by the upward movement of lever end 46a of shaft 46 are accomplished by either of two structures, both of which engage lever end 46a. An adjustment dial 52, preferably bearing visual indicia thereon, is connected by a cylindrical cam 53 eccentrically mounted on shaft 54. Cam 53 engages a lever 55 at a channel-shaped end portion 56 thereof, lever 55 being pivotally mounted on lever shaft 57 and engaging lever end 46a of shaft 46. When dial 52 is rotated downwardly, as shown by arrow B in FIG. 2, cam 53 rotates, as shown by arrow C, to pivot lever 55 about shaft 57, whereby shaft lever end 46a is urged upwardly, as shown by arrow A. The sum effect of these movements is to lower reverse roller 38 from feed roller 32 as may be done to obtain the optimum setting for a document of a greater thickness. Likewise, by rotating the adjustment dial 52 in an upward direction, the nip between rollers 38 and 32 may be reduced, such as may be necessary to adjust for wear on either roller or to optimally accommodate a thinner document.

Figure 4:
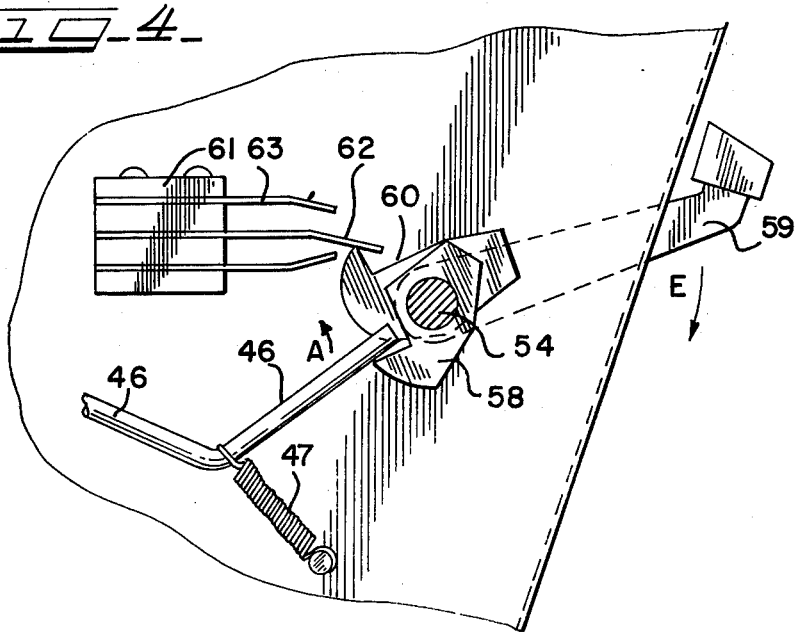
FIG. 4 taken along line 4—4 of FIG. 1 is an enlarged cross-sectional view showing details of the roller nip control mechanism, which additionally functions to open a switch for disengaging an associated magnetic (electric) clutch.

As set forth in FIG. 4, lever end 46a of nip adjustment shaft 46 is also engaged by a release cam 58, pivotably mounted also on shaft 54 which has a release lever 59 disposed at a terminal end of shaft 54 for rotation thereof. When release lever 59 is depressed, as shown by arrow E of FIG. 4, release cam 58 pivots about shaft 54 to urge lever end 46a upwardly, as shown by arrow A. Release lever 59 may be utilized for accommodating a very thick sheet and functions by traveling in an arc sufficiently large to effect a complete release of roller 38 from roller 32 by the nip control mechanism discussed in detail above.

The arcuate movement of release lever 59 also urges a switch cam 60, which is likewise pivotably mounted on shaft 54, upwardly to close a switch 61 by touching contact 62 with contact 63. Switch 61 may be used, for example, to control the functioning of the electric clutch 43, with the result that it would provide drive and accept a thicker document by increasing sufficiently the nip between rollers 32 and 38 so as not to be rejected by reverse roller 38. The thicker document would then be fed into the nip of a set of rollers in the associated photographic recorder (not shown).

The foregoing detailed description has been given for clearness of understanding only, and no unnecessary limitations are to be understood therefrom, as modifications of the present invention may be made by those skilled in the art without departing from the spirit thereof.

What is claimed is:

1. A sheet feeder apparatus comprising:
a frame;
sheet support means adapted to support a stack of sheets and moveable within said frame;
a pivotable arm mounted on said frame for engaging the stack of sheets, said pivotable arm normally in a first position and being moveable to a second position;
coil spring drive means operatively associated with said sheet support means for urging said sheet support means toward said pivotable arm;
a brake means connected to said sheet support means for preventing motion of said sheet support means within said frame toward said pivotable arm means, said brake means comprising:
rack means connected at one end thereof to said sheet support means;
pinion means engaging said rack means;
an electric motor connected to said pinion means, said electric motor having sufficiently high torque when inoperative to overcome said coil spring drive means urging of said sheet support means toward said pivotable arm when said pivotable arm is in said second position; and
a switch for operating said brake means, said switch being closed when said pivotable arm means is in said first position and open when said pivotable arm is in said second position, whereby said sheet support means may be depressed within said frame and loaded with a stack of documents which is urged by said coil spring drive means toward and into engagement with said pivotable arm means for feeding, which pivots said pivotable arm from said first position into second position thereby to activate said brake means until a portion of the sheets are fed and said pivotable arm pivots again to said first position.

2. The sheet feeder apparatus of claim 1 further comprising:
a clutch means disposed between said electric motor and said pinion means for permitting depression of said sheet support means during loading and resultant longitudinal movement of said rack means along said pinion means while preventing reverse rotational movement to said electric motor whereby a stack of sheets may be loaded onto said sheet support means without damage to said electric motor.

3. The sheet feeder apparatus of claim 1 wherein said coil spring drive means is disposed for longitudinal compression upon movement of said sheet support means away from said pivotable arm.

4. The sheet feeder apparatus of claim 1 further comprising idler roller means disposed on said sheet support means and engagable with said pivotable arm means when no sheets are supported on said sheet support means.

5. The sheet feeder apparatus of claim 1 wherein said pivotable arm means comprises:
a pickup roller shaft;
a pickup roller mounted on said pickup roller shaft;
a feed roller shaft;
a feed roller mounted on said feed roller shaft;
drive and support means connected to one of said shafts for providing rotation to and for supporting one of said shafts;
means for operationally connecting said pickup roller and said feed roller;
pivot bracket means mounting said pickup roller shaft and said feed roller shaft;
switch operating means carried by said pivotable arm means for closing and opening said switch; and
spring means for urging and pivoting said switch operating means into contact with said switch.

6. The sheet feeder apparatus of claim 5 further comprising:

electric clutch means connected to said drive and support means for selectively interrupting said rotation to said one shaft, whereby said feeding of said sheets may be manually and selectively controlled.

7. The sheet feeder apparatus of claim 6 further comprising reverse roller means in the form of shaft means mounting reverse roller means, said reverse roller means engageable with said pivotable arm means, whereby sheets will be fed individually by said feed roller.

8. The sheet feeder apparatus of claim 7 further comprising roller nip control means for adjusting the position of said reverse roller means relative to that of said pivotable arm means, whereby the extent of engagement between said reverse roller and said pivotable arm means may be adjusted to accommodate sheets of various thicknesses.

9. The sheet feeder apparatus of claim 8 wherein said nip control means comprises:

a nip control bracket means for mounting said reverse roller shaft means;

a nip control pivot shaft means for pivotably mounting said nip control bracket means; and a nip control shaft means connected at one end thereof to said nip control bracket means for providing pivoting to said nip control bracket means, said nip control shaft means having at an opposite end thereof a levered end portion, whereby said levered end portion may be manually operated to provide rotation to said nip control shaft means, and pivoting thereby to said nip control bracket means, to adjust thereby the extent of engagement between said pivotable arm means and said reverse roller means.

10. The sheet feeder apparatus of claim 8 further comprising:

switch means operable by said roller nip control means for selectively actuating said electric clutch means on said feed roller shaft, whereby very thick sheets may be fed through said apparatus.

* * * * *